United States Patent [19]

Kishi et al.

[11] 4,274,813

[45] Jun. 23, 1981

[54] SWASH PLATE TYPE COMPRESSOR

[75] Inventors: Atsuo Kishi; Toshio Sudo, both of Ibaraki, Japan

[73] Assignee: Hitachi, Ltd., Tokyo, Japan

[21] Appl. No.: 950,573

[22] Filed: Oct. 12, 1978

[30] Foreign Application Priority Data

Oct. 12, 1977 [JP] Japan ..... 52/121479

[51] Int. Cl.[3] ..... F04B 1/12; F04B 39/00

[52] U.S. Cl. ..... 417/269; 417/312

[58] Field of Search ..... 417/313, 269, 419; 181/264, 230

[56] References Cited

U.S. PATENT DOCUMENTS

| | | | |
|---|---|---|---|
| 1,910,498 | 5/1933 | Ploeger et al. | 417/312 |
| 2,823,850 | 2/1958 | Hiatze | 417/363 |
| 3,171,506 | 3/1965 | Hald | 417/312 |
| 3,385,515 | 5/1968 | Packer | 417/419 |
| 3,577,891 | 11/1971 | Nemoto | 417/269 |
| 3,785,751 | 1/1974 | Nemoto | 417/269 |
| 3,904,320 | 9/1975 | Kishi | 417/269 |
| 3,934,967 | 1/1976 | Gannaway | 417/312 |
| 4,061,444 | 12/1977 | Dirk | 417/312 |
| 4,079,809 | 5/1978 | Visnapou | 181/230 |
| 4,093,110 | 6/1978 | Johnson | 181/264 |

FOREIGN PATENT DOCUMENTS

| | | | |
|---|---|---|---|
| 2270460 | 5/1975 | France | 417/312 |

*Primary Examiner*—William L. Freeh

*Attorney, Agent, or Firm*—Craig and Antonelli

[57] ABSTRACT

In a swash plate type compressor, a partition plate member is located in a high pressure chamber of the compressor housing and divides the high pressure chamber into a plurality of small rooms which are communicated in series through a hole formed on the partition member. Each small room in the high pressure chamber and the partition member hole serves to reduce the resonant sound among the noise in a car or the like where the compressor is utilized.

16 Claims, 8 Drawing Figures

SWASH PLATE TYPE COMPRESSOR

BACKGROUND AND SUMMARY OF THE INVENTION

This invention relates to a swash plate type compressor of the type often used for an air conditioning system of a car, especially to an improvement of a silencing means of such a swash plate type compressor.

A swash plate type compressor is provided with a plurality of cylinder bores and pistons sliding in the cylinder bores. Compressed gas is intermittently discharged from each of the cylinder bores into a high pressure chamber. The compressed gas generates pressure pulsations. The frequency of a fundamental wave of the pressure pulsation is in proportion to the rotational speed of the drive shaft of the compressor. In addition to the fundamental wave, higher harmonics are generated when the gas is discharged from the cylinder bores into the high pressure chamber through a discharge valve, because the gas flow is restricted by the discharge valve. The frequency of the higher harmonics is 400 to 1,000 Hz (cycles per second).

The pressure pulsations are transmitted to a condenser through a pipe. The higher harmonics of the pressure pulsations are one of the sources of vibration of a car body and a resonant sound in a car, in instances where such a compressor is used for a car air conditioning system.

In compressors of this general type, in order to reduce the vibration and resonant sound, it has been contemplated to provide silencing means outside the compressor. Such silencing means required additional space around the compressor, thereby making it difficult to effectively utilize the space in an engine room of a car.

Japanese Published Utility Model Application No. 50-44313, filed in 1975, discloses a silencing chamber. The silencing chamber is downstream of the high pressure chamber and is communicated therewith through a plurality of holes. The silencing chamber and the high pressure chamber are made in a body in a side cover. Accordingly the conventional side cover must be exchanged for a side cover provided with a silencing chamber therein. Further, since a structure of the side cover with a silencing chamber is complicated, the manufacturing precision for casting the side cover is low. It is also difficult to cast the side cover with a silencing chamber. Furthermore, with such a construction, the volume of the compressor as a whole is large.

An object of the present invention is to provide a swash plate type compressor provided with a silencing means. In preferred embodiments, the compressor is constructed to be insertable in the compressor side cover in its entirety without requiring the making of a specially designed side cover.

Another object of the present invention is to provide a swash plate type compressor provided with a silencing means which is small in size and is easy to make.

In preferred embodiments of the present invention a silencing means is formed in a high pressure chamber of the side cover by disposing at least one partition plate member in the high pressure chamber.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
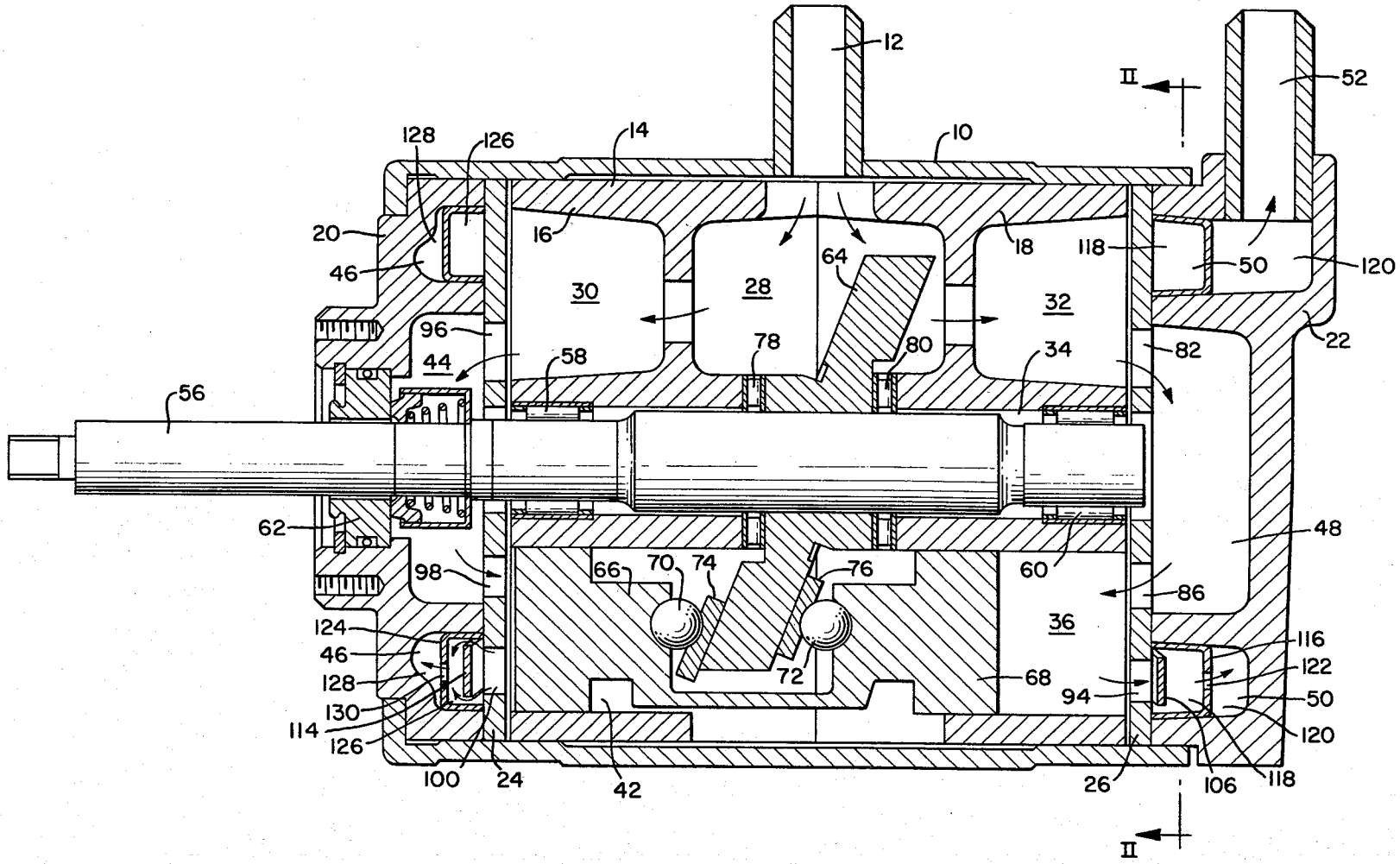
FIG. 1 is a vertical sectional view of a swash plate type compressor constructed in accordance with a preferred embodiment of the present invention.
Figure 2:
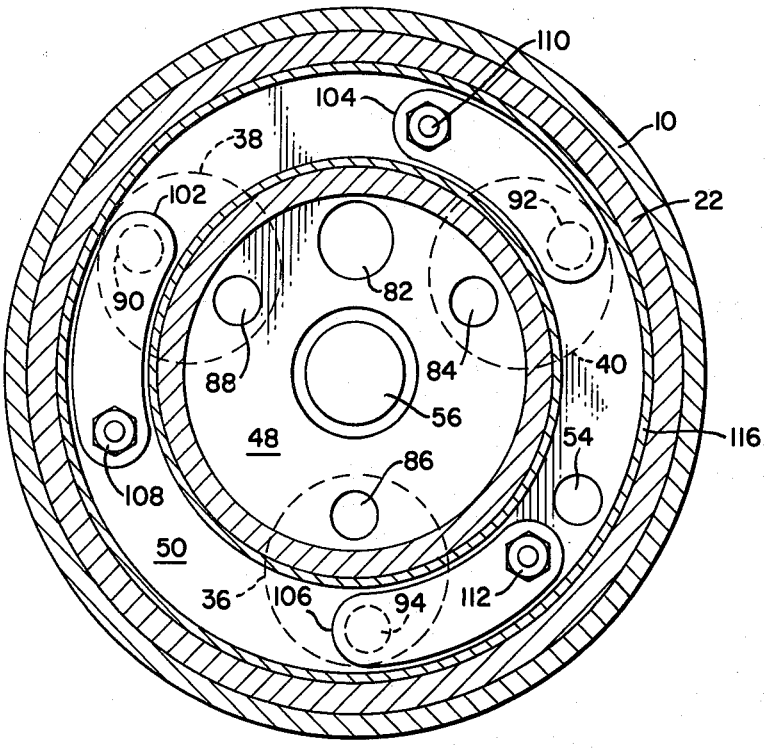
FIG. 2 is a cross sectional view taken along the line II—II of FIG. 1.

Referring now to FIG. 1 and FIG. 2, a cylindrical compressor housing 10 is provided with an inlet 12 of low pressure coolant gas at an axially central portion thereof. A cylinder block assembly 14 comprises front and rear cylinder blocks 16, 18 which are axially combined at the end surfaces thereof and are supported within the compressor housing 10. At the other end surfaces of the cylinder blocks 16, 18, there are attached front and rear side covers 20, 22 via respective valve plates 24, 26 so as to sandwich the cylinder block assembly 14.

The cylinder block assembly 14 forms a crank chamber 28 at its central portion. The crank chamber 28 is communicated with the inlet 12 and with enlarged paths 30, 32 in both cylinder blocks 16, 18. The cylinder block assembly 14 is provided with a bore 34 at a radially central portion thereof and six cylinder bores 36, 38, 40, 42 (two of six are not shown) spaced radially outwardly from the bore 34. Three of six cylinder bores are within the front cylinder block 16 and the remainder are within the rear cylinder block 18.

A front side cover 20 is provided with a cylindrical low pressure chamber 44 at its central portion and an annular high pressure chamber 46 spaced radially outwardly from the low pressure chamber 44. A rear side cover 22 is also provided with a cylindrical low pressure chamber 48 and an annular high pressure chamber 50. The rear side cover 22 is provided with an outlet 52 for pressurized coolant gas. The two high pressure chambers 46, 50 are communicated with each other through opening 54 (FIG. 2) penetrating the cylinder block assembly 14.

A drive shaft 56 is rotatably supported in the bore 34 by radial bearings 58, 60 disposed at both ends of the bore 34.

A cylindrical plate member 62 seals a gap between an outer periphery of the drive shaft 56 and an inner periphery of the low pressure chamber 44 in the front side cover 20.

A swash plate 64 is keyed on the drive shaft 56 for rotation in the crank chamber 28.

Each of six pistons 66, 68 (four of six are not shown) is slidably arranged within each of the cylinder bores 36, 38, 40, 42. The piston 66 and the piston 68 are interconnected, as are other corresponding pairs of pistons. Balls 70, 72 and shoes 74, 76 are located between the pistons 66, 68 and the swash plate 64 so that a rotating motion of the swash plate provides reciprocating motions of the pistons 66, 68. The thrust load from the pistons 66, 68 is supported by a pair of thrust bearings 78, 80 disposed between boss sections of the swash plate 64 and respective cylinder blocks 16, 18.

The valve plate 26 is provided with eight holes 54, 82, 84, 86, 88, 90, 92, 94 as shown in FIGS. 1 and 2. The hole 82 communicates the enlarged path 32 with the low pressure chamber 48. Each of holes 84, 86, 88 communicates the low pressure chamber 48 with each of the cylinder bores 40, 36, 38. Each of the holes 90, 92, 94 communicates the high pressure chamber 50 and each of the cylinder bores 38, 40, 36. The valve plate 24 is also provided with eight holes 96, 98, 100 (five of eight are not shown) which is symmetric with respect to the valve plate 26.

Discharge valve assemblies 102, 104, 106 are fixed to the valve plate 26 by bolts 108, 110, 112 in the high pressure chamber 50 as shown in FIG. 2. The discharge valve assemblies 102, 104, 106 serve as one-way valves only from the cylinder bores 38, 40, 36 to the high pressure chamber 50. Discharge valve assemblies 114 (two of three are not shown) of the front side are symmetric with respect to the discharge valve assemblies 102, 104, 106 of the rear side.

Figure 3:
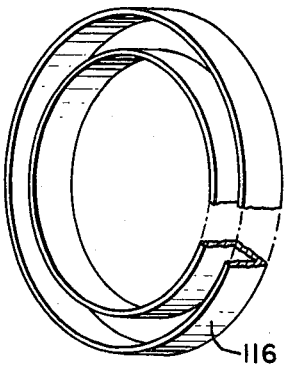
FIG. 3 is a schematic perspective view of the partition member shown in FIG. 1.

A partition plate member 116 is located in the high pressure chamber 50. The partition plate member 116 is a U-shaped cross section annular member as shown in FIG. 1 and FIG. 3.

The partition plate member 116 is made by pressing aluminum plate in the illustrated preferred embodiment. Material of the partition plate member 116 is not restricted to aluminum. Material capable of pressing or straining, for example thin steel or copper plate, can be substituted for aluminum, according to other contemplated embodiments. The U-shaped partition member 116 is inserted in the high pressure chamber 50 so that the partition plate member 116 covers the discharge valve assemblies 104, 106, 108 while the side walls of the partition plate member 116 are press-fitted to the side walls of the high pressure chamber 50 by means of its elasticity.

The partition plate member 116 divides the high pressure chamber 50 into two small rooms 118, 120. The first small room 118 is communicated with the second small room 120 through a hole 122 at the bottom of the partition plate member 116. The first small room 118 is also communicated with the cylinder bores 36, 38, 40 through the holes 90, 92, 94 respectively. The second small room 120 is also communicated with the outlet 52 of the compressed gas.

Another partition plate member 124 is located in the high pressure chamber 46 of front side. The configuration and material of the partition plate member 124 are the same as those of the partition plate member 116 on the rear side. The partition plate member 124 divides the high pressure chamber 46 into two small rooms 126, 128 which are communicated with each other through a hole 130 at the bottom of the partition plate member 124.

Figure 4:
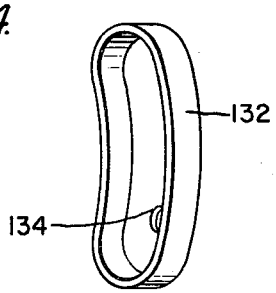
FIG. 4 is a schematic perspective view of another embodiment of a partition member according to the present invention.

FIG. 3 illustrates a first preferred embodiment of partition plate member 116. However, other embodiments are contemplated, such as the circular arc member 132 as shown in FIG. 4. The circular arc member 132 is also U-shape in its cross section and is provided with a hole 134 at the bottom. Three circular arc members 132 may be located in the high pressure chamber 50 so that each circular arc member 132 covers a respective one of the valve assemblies 102, 104, 106.

The total cross sectional area of the six holes 90, 92, 94, 100 (two of six are not shown) is the same as that of the outlet 52.

Gas flow in the compressor will be now described. The gas to be compressed is introduced into the crank chamber 28 through the inlet 12. Almost all of the gas in the crank chamber 28 flows into the low pressure chamber 44, 48 through the enlarged paths 30, 32 and holes 96, 82. Meanwhile, remainders in the crank chamber 28 lubricates and cools the thrust bearings 58, 60 and the radial bearings 78, 80 and flows into the low pressure chambers 44, 48.

When the drive shaft 56 is driven by an associated motor or engine, the swash plate 64 rotates and causes a reciprocating movement of the pistons 66, 68. The gas in the low pressure chamber 48 is introduced into the three cylinder bores 36, 38, 40 and is compressed by the pistons respectively. After having been compressed, the gas flows into the first small room 118 in the high pressure chamber 50 through the holes 90, 92, 94 and valve assemblies 102, 104, 106. The compressed gas in the first small room 118 gradually flows into the second small room 120 through the hole 122 of the partition plate member 116 and further flows out of the inlet 52.

On the other hand, the gas in the low pressure chamber 44 is introduced into the three cylinder bores 42 (two of three are not shown) and is compressed. The compressed gas flows into a small room 126. The gas in the small room 126 gradually flows into an adjacent small room 128 through the hole 130. The gas in the small room 128 is introduced into the small room 120 through the hole 54 (FIG. 2) which goes through the cylinder block assembly 14 from front side to rear side. The gas from front side joins the gas of rear side and flows out of the inlet 52 altogether.

Consequently, the pressure pulsations of the gas discharged from the inlet 52 are suppressed.

Figure 5:
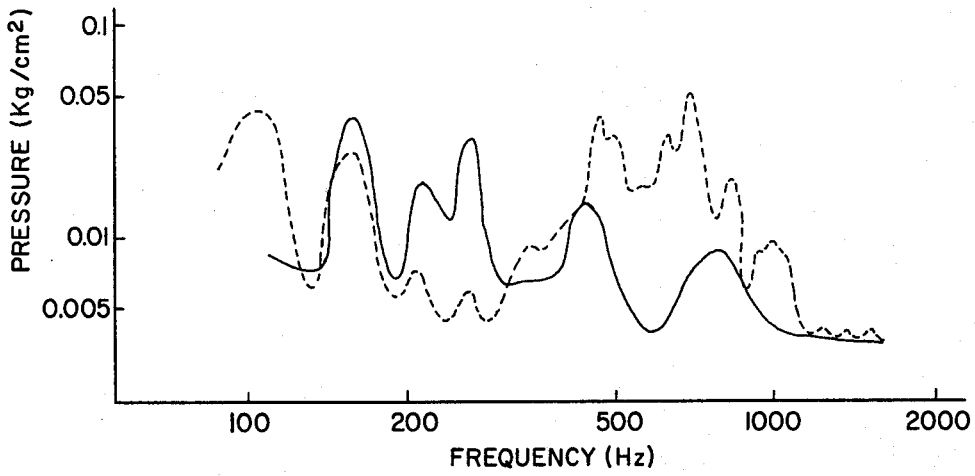
FIG. 5 is a graph showing a reduction of pressure pulsation of discharged gas from an outlet with respect to each frequency of the pressure pulsations.
Figure 6:
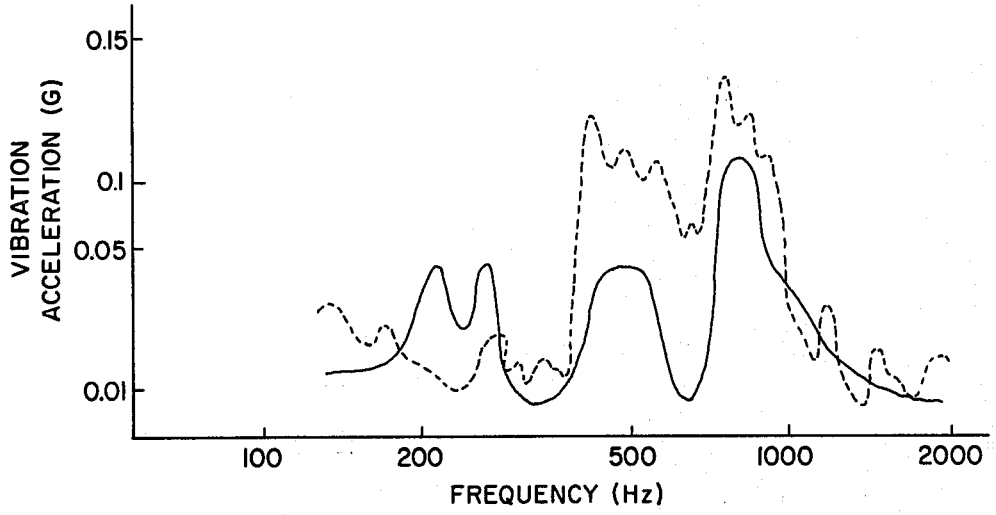
FIG. 6 is a graph showing a reduction of vibration acceleration of a car body with respect to each frequency of the pressure pulsations.
Figure 7:
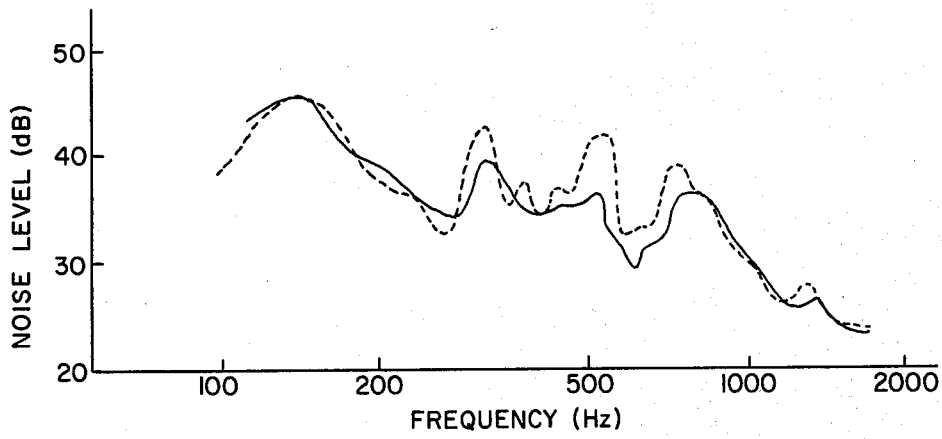
FIG. 7 is a graph showing a reduction of noise level in a car with respect to each frequency of pressure pulsations.

FIGS. 5 to 7 show effects according to the present invention. The results are obtained under the following conditions. A revolution number of the drive shaft is 1,000 rpm. Suction pressure of the gas to be compressed at the inlet is 1.6 kg/cm$^2$ G and discharge pressure of the compressed gas at the outlet is 15 kg/cm$^2$G. Ordinates of FIGS. 5 to 7 show, respectively, pressure of compressed gas discharged from an outlet of the compressor, vibration acceleration of the car body, and noise level in the car. Abscissas of FIGS. 5 to 7 show frequency of the waves of pressure pulsation. Broken lines show the characteristic curve obtained by the compressor which is not provided with a U-shaped partition plate member in a high pressure chamber. Solid lines show the characteristic curve obtained by the compressor according to the present invention shown in FIGS. 1 to 3.

The noise in a range of frequency 400 to 1,000 Hz is resonant sound in a car. As shown in FIG. 5, in a range of frequency 400 to 1,000 Hz, pressure pulsation is suppressed according to the present embodiment. The suppression of the pressure pulsations causes reduction in the vibration of the car body and the noise in the car as shown in FIG. 6 and FIG. 7.

On the other hand, in a range of frequency of less than 300 Hz, pressure pulsations are rather increased according to the present embodiment. The increase of the pressure pulsations causes an increase in the vibration of the car body in the same range of frequency as shown in FIG. 6. However, it is noted that the increase of the pressure pulsations does not cause the noise to increase in the car in the same range of frequency as shown in FIG. 7.

Figure 8:
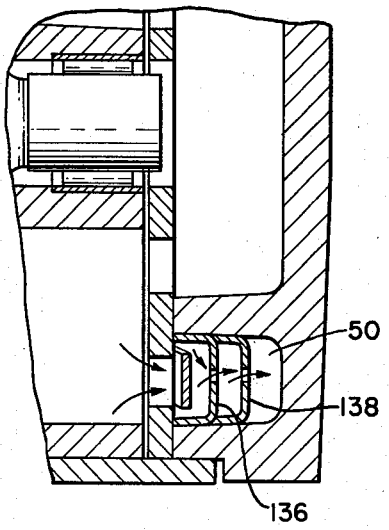
FIG. 8 is a vertical sectional view of another preferred embodiment of a swash plate type compressor according to the present invention.

Although in the illustrated preferred embodiments of the present invention, the partition plate members are located in both the front and rear high pressure chambers, they may be located only in the rear side high pressure chamber according to further contemplated embodiments. Further, FIG. 8 shows another embodiment of the present invention. In FIG. 8, two partition plate members 136, 138 are located in series in a high pressure chamber 50.

According to the present invention, since a high pressure chamber is divided into a plurality of small rooms communicated in series by inserting one or more partition plate members in the high pressure chamber, a conventional side cover can be utilized as it was. Further, a swash plate type compressor provided with a silencing means can be small in size and is easy to be made.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A swash plate type compressor comprising a cylindrical compressor housing having an inlet of coolant gas, a cylinder block assembly supported within said compressor housing and having a crank chamber communicated with the inlet at an axially central portion thereof, a drive shaft rotatably supported at its ends in said cylinder block assembly, said cylinder block assembly having a plurality of cylinder bores spaced radially outwardly from said drive shaft, front and rear side covers disposed at opposite ends of said cylinder block assembly, said side covers having a low pressure chamber at a radially central portion and a high pressure chamber spaced radially outwardly from the low pressure chamber, seal means disposed at one end of said drive shaft, front and rear valve plates interposed between said cylinder block assembly and respective ones of said side covers and having a first hole communicating the crank chamber with the low pressure chamber, second holes communicating the low pressure chamber with the cylinder bores and third holes communicating the cylinder bores with the high pressure chamber, a swash plate disposed in the crank chamber and keyed on said drive shaft so as to rotate therewith, and a plurality of pistons slidably arranged within the cylinder bores respectively, a rotating motion of said swash plate being converted to a reciprocating motion of said pistons, characterized in that the high pressure chamber is divided into a plurality of small rooms communicated in series, that the third holes communicate the cylinder bores with one end small room of the high pressure chamber, that the other end small room of the high pressure chamber in one of said side covers is communicated with an outlet of the compressed gas on the one of said side covers, and that the other end small room of the high pressure chamber in the other of said side covers is communicated with the high pressure chamber in the one of said side covers, and wherein said high pressure chamber is divided into said plurality of small rooms by a partition plate member having a U-shaped cross section, said partition plate member being inserted in the high pressure chamber so as to cover the third holes of said valve plates.

2. The swash plate type compressor as set forth in claim 1, wherein said partition plate member is located in said high pressure chamber at the rear side.

3. The swash plate type compressor set forth in claim 1, wherein said partition plate member is located in said high pressure chambers at the front and rear side.

4. The swash plate type compressor set forth in claim 1, wherein more than two partition plate members are located in series in said high pressure chamber.

5. Swash plate type fluid compressor comprising:

a compressor housing, a cylinder block assembly supported in said housing, said cylinder block assembly defining a piston accommodating space, a piston movably mounted in said cylinder space, a rotatably supported drive shaft, a swash plate carried by said drive shaft and drivingly connected to said piston to move said piston in response to rotation of the drive shaft, fluid inlet valve means for communicating low pressure fluid to said cylinder space, fluid outlet valve means for communicating high pressure fluid, after being pressurized by said piston, from said cylinder space, a high pressure chamber disposed in said compressor housing immediately downstream of the fluid outlet valve means, characterized in that partition plate member means are provided dividing said high pressure chamber into a plurality of small rooms communicated in series, one end small room of the high pressure chamber being in communication with said fluid outlet valve means and the other end small room of the high pressure chamber being in communication with an outlet of said high pressure chamber for the compressed fluid, whereby pressure pulsations and vibrations of said compressor are reduced over at least a portion of normal operating ranges of the compressor, and wherein said partition plate member means includes a single plate member press-fitted into said housing, said plate member having a hole therethrough for fluid.

6. Compressor according to claim 5, wherein said partition plate member means consists of a single plate member press-fitted into said housing, said plate member having a hole therethrough for fluid.

7. Compressor according to claim 5, wherein said partition plate member means includes a plurality of separate plate members press-fitted into said housing, said plate members each having holes therethrough for communicating the fluid with the respective rooms bounded by the plate members.

8. Compressor according to claim 5, wherein said compressor is part of an air conditioning system in a car and said fluid is a coolant.

9. Compressor according to claim 5, wherein said partition plate member is U-shaped.

10. Compressor according to claim 5, wherein said housing includes a side cover disposed at one end of the cylinder block assembly, wherein a valve plate is interposed between the cylinder block assembly and the side cover, said inlet and outlet valve means being disposed in said valve plate, and wherein said high pressure chamber is bounded by the valve plate and the side cover.

11. Compressor according to claim 10, wherein said single plate member is press-fitted into said side cover.

12. Compressor according to claim 11, wherein said cylinder block assembly defines a plurality of said piston accommodating spaces, and wherein a corresponding plurality of said pistons are movably mounted in respective ones of said spaces.

13. Compressor according to claim 12, wherein said single plate member extends over the outlet valve means of a plurality of said spaces.

14. Compressor according to claim 12, wherein a separate plate member is associated with each of said spaces.

15. Compressor according to claim 5, wherein said housing includes a front and rear side cover disposed at the respective front and rear ends of the cylinder block assembly, wherein respective valve plates are interposed between the cylinder block assembly and said side covers, said inlet and outlet valve means being disposed in said valve plates, with a plurality of said cylinder spaces and pistons being provided, at least one space opening to each of the front and rear valve plates and side covers, and wherein said high pressure chambers are bounded by the valve plates and side covers.

16. Compressor according to claim 13, wherein the partition plate member means includes at least one single plate member press-fitted into each of the side covers, said single plate members each having a U-shaped cross section and a hole therethrough for fluid.

* * * * *